United States Patent [19]

Phairr

[11] Patent Number: 4,674,454

[45] Date of Patent: Jun. 23, 1987

[54] REMOTE CONTROL ENGINE STARTER

[76] Inventor: Donald Phairr, 120 Ignaco Dr., Apt. D-1, Robins, Ga. 31098

[21] Appl. No.: 768,149

[22] Filed: Aug. 22, 1985

[51] Int. Cl.[4] ..... F02N 11/08

[52] U.S. Cl. ..... 123/179 B; 180/167; 290/38 C

[58] Field of Search ..... 123/179 B, 179 BG; 180/167; 290/38 C, 38 E, DIG. 3

[56] References Cited

U.S. PATENT DOCUMENTS

| | | | |
|---|---|---|---|
| 3,455,403 | 7/1969 | Hawthorne | 123/179 B |
| 3,478,730 | 11/1969 | Bucher | 123/179 BG |
| 4,227,588 | 10/1980 | Biancardi | 290/38 E |
| 4,236,594 | 12/1980 | Ramsperger | 290/38 E |
| 4,296,334 | 10/1981 | Wong | 290/DIG. 3 |
| 4,392,059 | 7/1983 | Nespor | 123/179 BG |
| 4,577,599 | 3/1986 | Chmielewski | 123/179 B |

OTHER PUBLICATIONS

Hammacher Schlemmer–Remote Control Car Starter No. 25700R.

*Primary Examiner*—Andrew M. Dolinar

*Attorney, Agent, or Firm*—Hill, Van Santen, Steadman & Simpson

[57] ABSTRACT

A remote control automobile engine starting apparatus has a remote control unit with a transceiver for transmitting engine starting and automobile heater and air conditioner control signals to a remotely controlled starting circuit within the automobile. The starting circuit makes a first attempt at starting the automobile engine and, if the first attempt fails, a second attempt is automatically made. Safety features include a hood switch, automatic door locks, a remotely controlled engine kill switch, and a timer for stopping the engine after it has run for a predetermined period of time.

9 Claims, 4 Drawing Figures

REMOTE CONTROL ENGINE STARTER

BACKGROUND OF THE INVENTION

1. Field of the Invention

The present invention relates to an apparatus for remotely starting an internal combustion engine, such as an automobile engine, including a remote control unit and a receiver unit connected to various operating systems in the automobile and under control of the remote control unit.

2. Description of the Prior Art

Many types of remote control engine starters are known. For example, Hildreth et al, U.S. Pat. No. 3,811,049 discloses a remote engine starter having an auxiliary electrical circuit in parallel with the usual electrical circuit of an automobile which auxiliary circuit is under control of a remote receiver.

Lessard, U.S. Pat. No. 3,790,806 discloses a remote engine starting system including a radio transmitter, the actuation of which initiates the timing of two preselected periods, the first of which controls the actuation of the engine cranking system until the engine is started and the second of which controls the period during which the engine will run.

Shaheen, U.S. Pat. No. 3,675,032; Laang, U.S. Pat. No. 3,727,070; and Gelbman, U.S. Pat. No. 2,632,120 each discloses remote automobile starting systems wherein electrical cables are connected between the remote control unit and the automobile engine.

Lastly, Siebert, U.S. Pat. No. 3,124,118 discloses a remote control which starts an internal combustion engine upon the reception of a photoelectric signal.

Each of the prior art starters make only a single attempt at starting the engine. The prior art devices generally only control the starting of the automobile, and not other automotive systems. The prior art devices do not include means for indicating whether the engine has stopped running.

SUMMARY OF THE INVENTION

It is an object of the present invention to provide a remote control engine starter which will automatically make subsequent attempts to start the automobile should the initial starting attempt fail.

It is another object of the present invention to provide a remote control engine starter which prevents theft of the automobile, both prior to and subsequent starting of the engine.

It is a further object of the present invention to provide a remote control engine starter which transmits an indication of the condition of automobile systems to the remote control unit.

These and other objects of the present invention are inventively achieved in a remote control engine starter having a transmitter for transmitting a plurality of signals to a control and starter system connected in an automobile. The remote control unit also includes a receiver for receiving signals transmitted by the engine control system, which signals indicate the state of the automobile engine and automobile systems. The remote control unit may also include a programmed controlled portion for encoding the transmitted signals for security purposes and to perform a plurality of control functions.

The engine control and starter system includes a receiver for detecting the signals sent by the remote control unit to initiate starting of the engine. The starting functions are controlled by a triple timer which times the initial cranking of the starter motor and, should the engine fail to start during the prescribed time, also provides a delay period and a subsequent cranking of the starter motor. On starting of the engine, a timer also limits the maximum running time of the engine. Means are provided in the engine control system for shutting the engine off once the interior automobile compartment reaches a desired temperature and for stopping the engine by remote control. The engine control system also includes a transmitter for transmitting signals to the remote control unit to indicate the condition of the automobile engine and the automobile systems.

The present invention may also incorporate an automobile alarm system so that the remote control unit may be used to control the alarm.

DESCRIPTION OF THE PREFERRED EMBODIMENT

Figure 1:
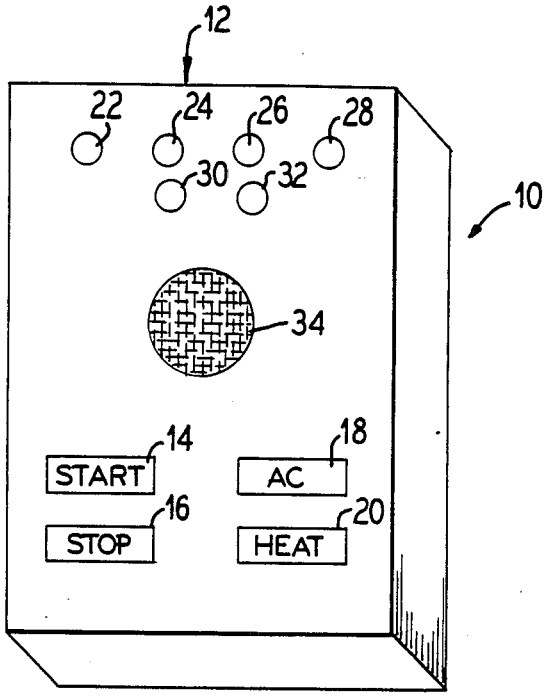
FIG. 1 is a perspective view of the remote control unit of the present invention.

FIG. 1 shows a remote control unit generally at 10 for use in remotely starting an automobile engine including a case 12, control buttons 14, 18, 16 and 20, indicator lights 22, 24, 26, 28, 30 and 32, and speaker 34. The remote control 10 is preferably small and portable so that it may be carried easily for use in remotely starting an automobile. The remote unit 10 includes a number of buttons 14–20 that cause transmission of control signals for controlling the operation of the starting circuit shown in FIG. 3. These include a start button 14 by which the automobile engine may be started, a stop button 16 by which the running automobile engine may be stopped, an air conditioner button 18 for starting the air conditioning system in the automobile to reduce the interior compartment temperature on hot days, and a heater control button 20 for starting the automobile heater to warm the interior compartment of the automobile.

The remote control 10 also includes a number of lights 22-32 which indicate the condition of the automobile systems including an engine running light 22 which indicates that the automobile engine has started and is running, an engine stall light 24 which indicates that the automobile engine has stalled prematurely, a ready to enter light which indicates that the interior compartment temperature has reached a desired temperature setting, an air conditioner "on" light 28 which indicates that the air conditioning system has been activated, a heat "on" light 30 which indicates that the automobile heater is activated, and an optional check monitor light 32 which indicates that a fault has been detected in one of the automobile operating systems by the automobile's monitoring system.

In a preferred embodiment of the remote control 10 the lights 22-32 are color-coded to correspond to their function, for example; the "on" light being green, the "off" light being red, the air conditioner light blue, the heat light red, and the check monitor light yellow.

A speaker 34 is also included to provide an audio indication in conjunction with the visual indicators. The speaker 34 may be used to emit distinctive sounds which correspond to the various functions of the indicator lights 22–32.

Figure 2:
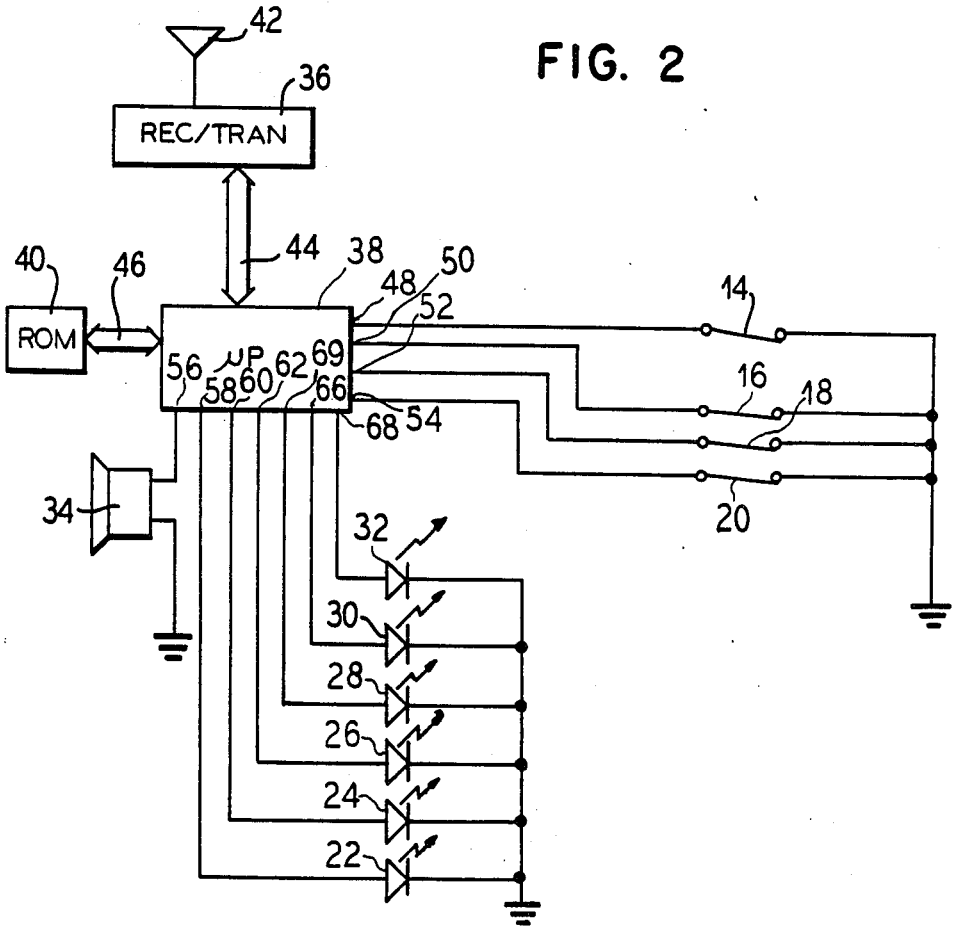
FIG. 2 is a functional block diagram of the remote control unit of FIG. 1.

*FIG. 2 is a block diagram of the circuitry of the remote control unit of FIG. 1*, including a receiver/transmitter unit 36 and a microprocessor 38 with its associated ROM 40. The receiver/transmitter 36 is a standard AM transmitter which is connected to an antenna 42 for transmitting and receiving information to and from the remote starter unit, which will be described in conjunction with FIG. 3. The receiver/transmitter 36 communicates with the microprocessor 38 over a communication bus 44. A second communcation bus 46 is connected between the microprocessor 38 and the ROM 40. Inputs 48, 50, 52 and 54 of the microprocessor 38 are connected to the switches corresponding to the buttons 14, 16, 18 and 20. A first output 56 of the microprocessor is connected to the speaker 34 which is preferably a metal buzzer, and outputs 58, 60, 62, 64, 66 and 68 are connected to the lights 22, 24, 26, 28, 30 and 32, respectively, which are shown as light emitting diodes.

The remote control 10 operates as follows: closing one of the switches 14 through 20 causes the microprocessor 38 to retrieve a code from the ROM 40 corresponding the function assigned to the switch, which functions will be described in more detail hereinafter. The code is then fed into the transmitter portion of the receiver/transmitter 36 and transmitted over the antenna 42 as a coded AM signal.

The control and starter unit has the ability to generate encoded signals and; upon receipt of an encoded signal from the starter unit mounted within the car, the receiver portion of the receiver/transmitter 36 the encoded signal to the microprocessor 38, where it is decoded with the aid of the ROM 40. After decoding the signal, the microprocessor 38 will cause the speaker 34 to emit an audio signal, thereby alerting the operator to the receipt of an important signal. The microprocessor 38 also causes one of the lights 22–32 to be lit, corresponding to the function indicated by the encoded signal.

An operator of the present device is thus able to transmit a variety of control signals to the starter unit by the operation of the switches 14–20 and, further, is informed of the status of the starter unit and the automobile, as indicated by the audio signal from the speaker 34 and the illuminated lights 22–32.

Figure 3:
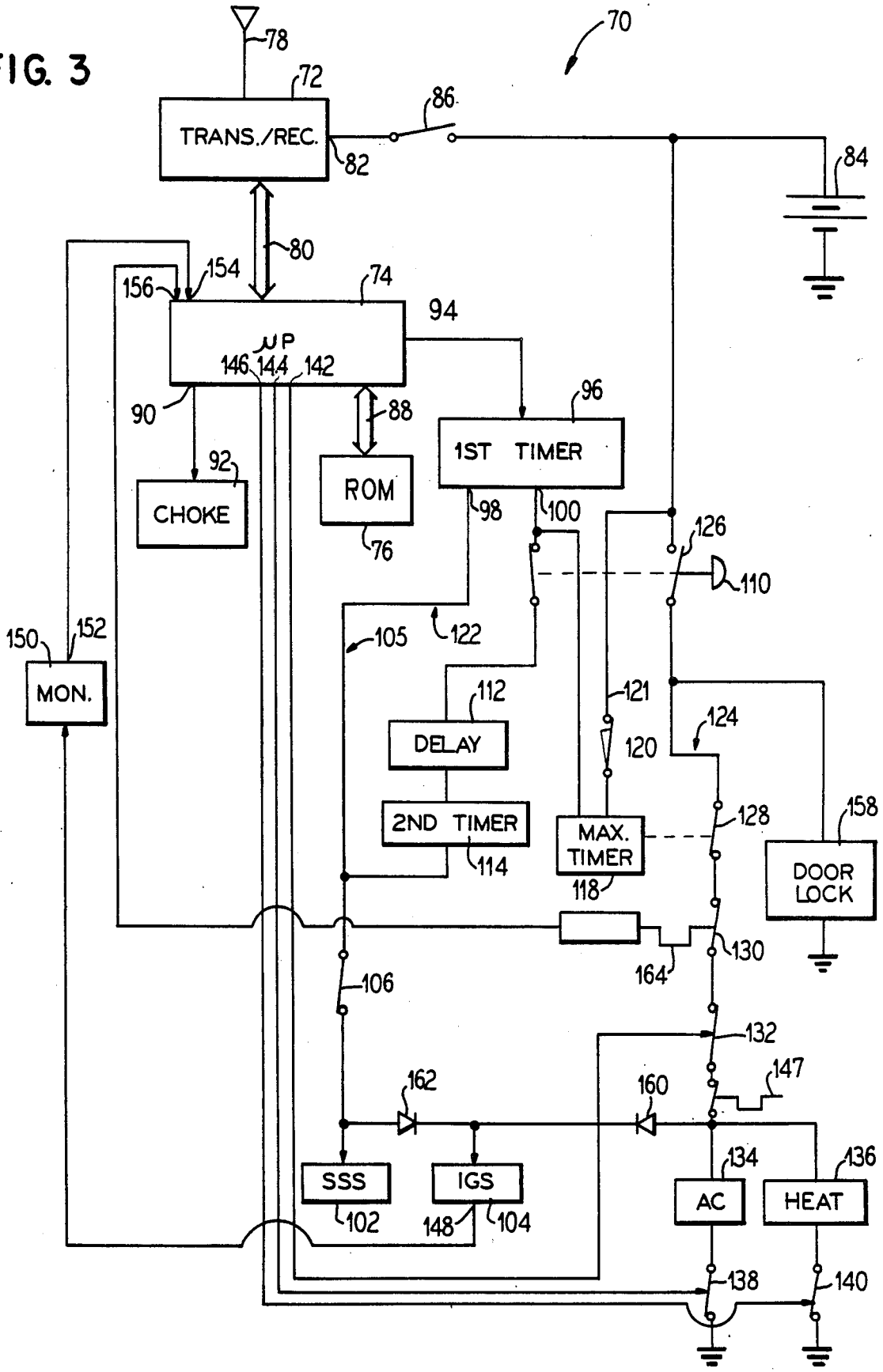
FIG. 3 is a functional block diagram of a radio controlled starter embodying the principles of the present invention.

FIG. 3 shows the starter unit generally at 70 connected to various automotive operating systems for remotely starting an automobile. The remote starter 70 includes a receiver/transmitter unit 72, a microprocessor 74, a ROM 76 and a plurality of timers and switches. More specifically the receiver/transmitter 72 is connected to an antenna 78, which may be the antenna for the automobile radio. The receiver/transmitter 72 communicates over a communication bus 80 with the microprocessor 74. Power is supplied to the receiver/transmitter 72 over a power input 82 which is connected the battery 84 of the automobile. Between the power input 82 and the battery 84 is a hood switch 86. The hood switch 86 is normally closed and moves to an open position when the hood of the automobile is opened, to prevent remote starting of the automobile engine when the hood is open.

The microprocessor 74 is connected by a communication bus 88 to the ROM 76 in which signal coding information is stored. The microprocessor 74 has a first output 90 connected to set the choke 92 of the automobile. A second microprocessor output 94 is connected to trigger a first timer 96. The first timer 96 includes two outputs 98 and 100 where the output 98 operates to connect the battery 84, normally 12 volts, to the automobile's starter solenoid 102 and ignition system 104 over lead 105. Between the starter solenoid 102 and the first timer 96 is a neutral safety switch 106 that opens the lead 105 when the transmission of the automobile is not in either park or neutral position.

The second output 100 of the first timer 96 is connected through a switch contact 108 of a vacuum advance switch 110 and to a delay timer 112. The vacuum advance switch 110 is connected to the automobile vacuum advance to open the contact 108 when the engine starts. The delay timer 112 is connected to feed 12 volts to trigger a second timer 114, which is substantially identical to the first timer 96. The second timer 114 has an output 116 which is likewise connected to the starter solenoid 102 and ignition system 104 through the neutral safety switch 106.

The output 100 of the timer 96 is also connected to trigger a maximum time timer 118. A key activated switch 120 is disposed in the lead 121 which supplies power to the maximum timer 118. The switch 120 opens when the ignition key is turned so that the maximum timer is stopped.

The microprocessor 74, the first and second timers 96 and 114, and the delay timer 112 forms a first parallel circuit 122. A second parallel circuit 124 is connected to the positive terminal f the battery 84 and includes normally open contact 126 of the vacuum advance switch 110, which closes when the engine starts. A maximum time cutoff switch 128 which is controlled by the maximum timer 118, a thermostatically controlled switch 130 and a remotely controlled engine kill switch 132 are also included in the second circuit 124. The second parallel circuit 124 supplies power to the ignition system 104 after the engine has started, enabling the engine to continue running. The second circuit 124 also supplies power to an automobile air conditioner 134 and an automobile heater 136. The operation of the air conditioner is controlled by a remotely controlled, ground connecting switch 138 and the operation of the heater 136 is controlled by a remotely controlled, ground connecting switch 140. The kill switch 132, the air conditioner switch 138, and the heater switch 140 are controlled by outputs 142, 144 and 146, respectively, of the microprocessor 74. A thermostatically control switch 147. Is located in second circuit 124. And opens upon the over heating of the automobile engine.

The ignition system 104 includes a monitor output 148 which feeds a monitor system 150, such as found in many late model automobiles. An output 158 of the monitor 150 is fed to an input 154 of the microprocessor 74. An input 156 is also provided at the microprocessor 74 which is connected to monitor the operation of the thermostatically controlled switch 130. A door locking system 158 is preferably included to lock the automobile doors remotely. The door locking system 158 may either be connected to the first circuit 122 or to the second circuit 124, as shown.

The starter 70 operates as follows: a coded start signal is received from the remote unit 10 over the antenna 78. The receiver 72 transmits it over the bus 80 to the microprocessor 74 for decoding. The microprocessor 74, upon verifying the code through the use of the ROM 76, determines that the encoded signal is a start signal and transmits a choke setting signal over output 90 to the choke 92. After the choke 92 has been set, a timer triggering signal is fed from output 94 to the first timer 96. Upon receiving the trigger signal, the first timer 96 connects battery power to the starter solenoid 102 and to the ignition system 104 for a period of time, preferably six seconds, to start the engine. This connection is only made if the neutral safety switch 106 is in the closed position, corresponding to the automobile transmission being in either the neutral or the park position. Should the automobile engine start during this first attempt, the contact 126 of the vacuum advance switch 110 is closed, feeding 12 volt power to the ignition system 104 for the continued running of the automobile engine.

The first timer 96 sends a trigger signal over the output 100 at the same time that battery power is connected through the output 98, thereby starting the timing operation of the delay timer 112 and the maximum timer 118. If the automobile engine has started on the first attempt, the switch contact 108 of vacuum advance switch 110 is in the open position, thereby interrupting the trigger signal to the delay 112. If the automobile engine has not started on the first attempt, the contact 108 of the vacuum advance switch 110 is in the closed position, enabling the trigger signal to pass therethrough and to the delay timer 112. The delay timer 112, after a delay of preferably eight seconds, sends a trigger signal to the second timer 114. The second timer 114, upon receiving the trigger signal, connects battery power to the starter solenoid 102 and ignition system 104 through an output 116. The second timer 114, thus, automatically makes a second attempt to start the automobile engine should the first attempt fail.

In the embodiment shown in FIG. 3, a diode 160 is connected between the first and second parallel circuits 122 and 124 to prevent the starting signals from reaching the air conditioner 134 and heater 136.

Should the engine start during the second attempt, the switch contact 108 of the vacuum advance switch 110 opens and the switch contact 126 closes so that power is no longer connected to the starter solenoid 102 but is continued to be fed to the ignition system 104 by the second parallel circuit 124. The application of power through the circuit 124 to the ignition system 104 enables the automobile engine to continue to run until one of the switches 128, 130 or 132 is opened. The power applied by the circuit 124 is prevented from reaching the starter solenoid 102 by a diode 162, so that the starter 102 is not energized during the running of the automobile engine.

The maximum timer 118, which was triggered by a signal on output 100 of the first timer 96, times a maximum period during which the engine will be allowed to run unattended, in a preferred embodiment this period is about 10 minutes although other times may be selected. After the passage of the maximum time, the timer 118 will cause the switch 128 to open, thereby removing power from the ignition system 104 and causing the engine to stop running. The operation of the maximum timer 118 is controlled by the automobiles ignition switch 120 so that the operation of the ignition switch 120 by the automobile key will prevent the maximum timer 118 from stopping the engine, and enable an automobile operator to drive the automobile without the engine being shut off.

The thermostatically controlled switch 130 is connected to a thermostat 164 which responds to the temperature of the interior compartment of the automobile. The thermostat 164 can be set so that the automobile engine is stopped by the switch 130 when the interior compartment reaches a predetermined temperature. When the thermostat 164 opens, a signal is sent to the microprocessor 74 at input 156, after which the microprocessor 74 causes an encoded signal to be sent to the remote unit 10 indicating the interior compartment has reached the desired temperature.

As a safety feature, a kill switch 132 is connected in series with the circuit 124 and is remotely controlled by the output 146 of the microprocessor 74. Reception of an encoded stop engine signal by the receiver 72 will cause the microprocessor 74 to open the kill switch 132.

Once the engine is running and the switch 126 of the vacuum switch 110 is closed, power is connected to the air conditioner 134 and heater 136. Operation of the air conditioner and heater is controlled by the respective switches 138 and 140 through the microprocessor outputs 144 and 142, respectively. Reception of an encoded air conditioner start signal by the receiver 72 causes the microprocessor 74 to close the normally open switch 138, thereby turning on the automobile air conditioner 134. In similar fashion, reception of a heater start signal by the receiver 72 causes the microprocessor 74 to close the normally opened switch 140, thereby turning on the automobile heater 136.

An output 148 of the ignition system 104, such as is frequently found in automobiles to sense the stalling of the engine is fed to a monitor circuit 150. The monitor circuit 150 in late model cars would be the circuit which checks the condition of the automobile upon starting. In older automobiles, the monitor circuit 150 would be the circuit which indicates an engine stall, such as by causing the engine oil light to illuminate on the dashboard. A signal from the monitor circuit 154 to the microprocessor 74 indicates an engine stalled condition. The microprocessor 74, upon receipt of such signal, sends a signal over a bus 80 to the receiver/transmitter 72, which causes the transmitter portion thereof to transmit a signal to the remote control unit shown in FIGS. 1 and 2. Late model cars which have a sophisticated monitor system 150 would also transmit a problem signal to the remote control unit 10 upon the existance of other trouble conditions. The ignition input 154 of the microprocessor 74 would also be used to transmit a signal to the remote control unit 10 indicating that the automobile engine is running. Encoded signals could also be transmitted by the transmitter portion of the receiver transmitter 72 upon the closing of either the air conditioner switch 138 or the heater switch 140.

Figure 4:
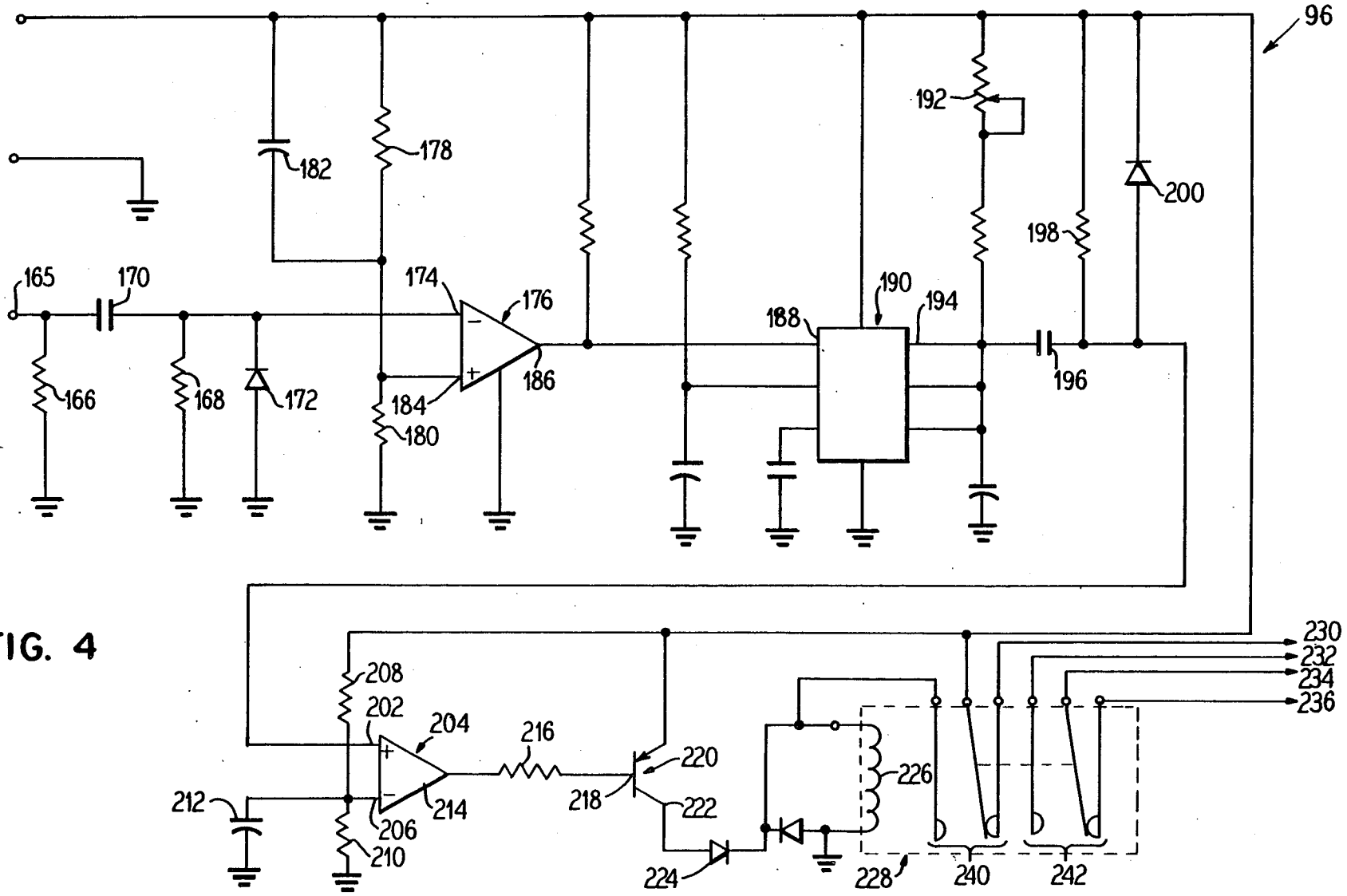
FIG. 4 is a circuit diagram of a timer portion of the device of FIG. 3.

FIG. 4 shows a detailed circuit diagram of the timer 96, although the timer 114 is similar. The timer circuit, designated generally 196, includes a trigger input 165 connected through filtering resistors 166 and 168, capacitor 170, and diode 172 to an inverting input 174 of a comparator 176. The comparator 176 includes level setting resistors 178 and 180 as well as a capacitor 182 connected to a non-inverting input 184. An output 186 of the comparator 176 is connected to a trigger input 188 of a timer 190. The timer 190 is connected in a single shot fashion including a variable resistor 192 for setting the duration of the output signal. The output lead 194 of the timer 190 is connected through a capacitor 196, a resistor 198, and a diode 200 to a noninverting input 202 of a second comparator 204. An inverting input 206 of the comparator 204 is connected to level setting resistors 208 and 210, and capacitor 212. An output 214 of the comparator 204 is connected by a resistor 216 to a base 218 of a transistor 220. The collector 222 of the transistor 220 is fed through a diode 224 to a coil 226 of a double-pole double-throw relay, shown generally at 228. The relay 228 includes outputs 230, 232, 234 and 236.

Upon receipt of the trigger pulse at the input 165, the timer 190 will generate a single shot pulse of a predetermined duration, which in a preferred embodiment is six seconds. The timer pulse, acting through the comparator 204 and the transistor 220, causes the contacts of the relay 228 to close for the duration of the pulse. In the first timer 96, the relay contacts of the first contact pair 240 connects 12 volts to the timer output 98, thereby energizing the starter solenoid 102 and ignition system 104. The second contact pair 242 connects a 5 volt trigger signal to the timer output 100, starting of the delay timer 112 and maximum timer 118.

In the second timer 114, the timer circuit is substantially similar and the first contact pair, corresponding to the contacts 240, connect a 12 volt signal to the output 116 to energize the starter solenoid 102 and ignition system 104. The second contact pair, corresponding to the contacts 242, are not connected in the second timer 114.

Thus there has been shown and described a remote control automobile starting system having encoded signals to provide a multiplicity of functions, as well as to provide identity information for security purposes, thereby preventing others from starting an automobile with a similar system. The present remote control starting system includes means for automatically making a second attempt at starting the engine should the engine fail to start on a first try, as well as means to turn on the air conditioner or heater in the automobile, means to prevent the automobile engine from running for an unnecessary period of time, means to turn off the engine should the interior compartment temperature reach a desired level, and means for remotely stopping the automobile engine. The present system also includes the safety features of a hood switch and an automatic door locking system.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A remote control automobile engine starting apparatus comprising:

a remote control unit having means for generating a plurality of first encoded signals, the encoded signals including a start signal, a stop signal and a heater start signal, radio transmitting means in said remote control unit for transmitting the first encoded signals, radio receiving means in said remote control unit for receiving a plurality of second encoded signals, the second encoded signals including an engine running signal, a stall signal, a ready-to-enter signal, and a heater-on signal, means in said remote control unit for indicating the receipt of the second encoded signals, said indicating means including a plurality of light emitting elements, a first of said light emitting elements connected for illumination upon receipt of said engine running signal, a second of said light emitting elements connected for illumination upon receipt of said stall signal, a third of said light emitting elements connected for illumination upon receipt of said ready-to-enter signal and a fourth of said light emitting elements connected for illumination upon receipt of said heater-on signal, a remotely controlled starter system associated with an automobile engine including means for receiving the first encoded signals, means in said starter system for operating an automobile engine starter for a predetermined time upon the receipt of the start signal, means in said starter system for providing a predetermined delay following the operation of the automobile engine starter, means in said starter system for operating the automobile starter for a second predetermined time following said delay, means in said starter system for generating the engine running signal in response to starting of an automobile engine, means in said starter system for stopping the automobile engine upon receipt of said stop signal, means in said starter system for starting an automobile heater upon receipt of said heater start signal, means in said starter system for generating the stall signal upon the automobile engine stalling, means in said starter system for generating the ready-to-enter signal upon an interior compartment of an automobile reaching a predetermined temperature, means in said starter system for generating the heater-on signal upon the heater being started, and means in said starter system for transmitting the second encoded signals.

2. A remote control automobile engine starting apparatus as claimed in claim 1 further comprising:

means in said starter system for stopping the automobile engine after it has run for a third predetermined period of time.

3. A remote control automobile engine starting apparatus as claimed in claim 1 further comprising:

first and second parallel circuits in said starter system, said first parallel circuit being connected to start the automobile engine; and said second parallel circuit being connected to control the running of the automobile engine.

4. A remote control automobile engine starting apparatus as claimed in claim 1, wherein the first encoded signals include an air conditioner start signal, wherein said indicating means includes a fifth light emitting element connected for illumination upon receipt of an air conditioner-on signal, and further comprising:

means in said starter system for starting an automobile air conditioner upon receipt of said air conditioner start signal, and means in said starter system for generating the air conditioner on signal upon starting of the automobile air conditioner.

5. A remote control automobile engine starting apparatus as claimed in claim 1, wherein said indicating means includes a speaker connected to emit distinctive audio signals upon receipt of each one said plurality of second encoded signals.

6. A remote control automobile engine starting apparatus comprising:

a remote control unit, a first transmitter in said remote control unit, a first encoder connected to said first transmitter to provide first encoded signals thereto for transmittal by said first transmitter, means for selectively enabling said encoder to provide said first encoded signals to said first transmitter, said first encoded signals including a start signal and a stop signal, a first receiver in said remote control unit for receiving second encoded signals, a first decoder connected to said first receiver for decoding said second signals received by said first receiver, a plurality of indicators connected to said first decoder to generate indications in response to a receipt of said second signals by said first receiver, a remotely controlled starter system associated with an automobile engine, a second receiver in said remotely controlled starter system for receiving said first signals from said first transmitter, a second decoder connected to said second receiver to decode said first signals received by said second receiver, a second transmitter in said remotely controlled starter system for transmitting said second signals to said first receiver in said remote control unit, means connected to said second transmitter for sensing the condition of systems in an automobile to cause said second transmitter to transmit said second signals, said condition sensing means including means for sensing a stall condition of an automobile engine and means for sensing the temperature of an interior compartment of an automobile, wherein said second signals include a stall signal and a ready-to-enter signal, said ready-to-enter signal indicating a predetermined interior compartment temperature range, a first parallel circuit including a first timer controlled by said second decoder upon receipt of a start signal by said second receiver, said first timer connected to control the duration of a first engine starting attempt upon activation by said second decoder, a delay timer connected to said first timer to receive a delay initiating signal from said first timer, a second timer connected to said delay timer to receive a delayed signal therefrom, said second timer connected to control the duration of a second staring attempt upon activation by said delay timer; and a second parallel circuit connected to enable an automobile engine to run including means for stopping the automovile engine, said stopping means being controlled by said second decoder upon receipt of a stop signal by said second receiver, means for disconnecting said first parallel circuit and simultaneously connecting said second parallel circuit upon starting of the automobile engine, wherein said plurality of indicators includes a stall indicator connected for activation by said second decoder upon receipt of said stall signal by said first receiver, and a ready-to-enter indicator connected for activation by said second decoder upon receipt of said ready-to-enter signal by said receiver.

7. A remote control automobile engine starting apparatus as claimed in claim 6 further comprising a second means for stopping the automobile engine subsequent to the engine running for a predetermined period of time.

8. A remote control automobile engine starting apparatus as claimed in claim 6, wherein said first encoded signals include a heater signal and an air conditioner signal, and further comprising:

means for controlling an air conditioner system of an automobile and connected for control by said second decoder upon receipt of an air conditioner signal by said second receiver, and means for controlling a heating system of an automobile and connected for control by said second decoder upon receipt of a heater signal by said second receiver.

9. A remote contorl automobile engine starting apparatus as claimed in claim 6, wherein said plurality of indicators includes a speaker for audio indications, and a plurality of light emitting elements for visual indications.

* * * * *